US005111171A

United States Patent [19]

von Bonin et al.

[11] Patent Number: 5,111,171

[45] Date of Patent: May 5, 1992

[54] RELAY HAVING CONTACT VIEWING LENES IN THE COVER

[75] Inventors: Jochen von Bonin, Gosheim; Eberhard Kirsch, Wehingen, both of Fed. Rep. of Germany

[73] Assignee: Hengstler Bauelemente GmbH, Wehingen, Fed. Rep. of Germany

[21] Appl. No.: 579,012

[22] Filed: Sep. 7, 1990

[30] Foreign Application Priority Data

Sep. 8, 1989 [DE] Fed. Rep. of Germany ..... 3929877

[51] Int. Cl.[5] ..... H01H 9/02

[52] U.S. Cl. ..... 335/202; 335/130; 335/17

[58] Field of Search ..... 335/78-85, 335/124, 128, 129-132, 202, 295, 17; 200/303

[56] References Cited

U.S. PATENT DOCUMENTS

| | | | |
|---|---|---|---|
| 2,985,736 | 5/1961 | Coker et al. | 335/132 |
| 3,146,325 | 8/1964 | Gribble | 335/202 |
| 3,270,301 | 8/1966 | Bengtsson | 335/129 |
| 3,509,502 | 4/1970 | Maynard et al. | 335/130 |
| 3,993,971 | 11/1976 | Ono et al. | 335/80 |

*Primary Examiner*—Leo P. Picard
*Assistant Examiner*—L. Donovan
*Attorney, Agent, or Firm*—Robbins, Dalgarn, Berliner & Carson

[57] ABSTRACT

A relay with a safety spring set such that the spring contact sets are arranged in chambers, which are freely accessible from the outside via openings when the cover is removed so that the spring contact sets can be manipulated. To prevent broken pieces from ending up in the other regions of the relay in the event of breakage of the contact springs of the spring contact sets, the cover has inwardly directed projections which seal the openings of the chambers when the cover is in place.

3 Claims, 1 Drawing Sheet

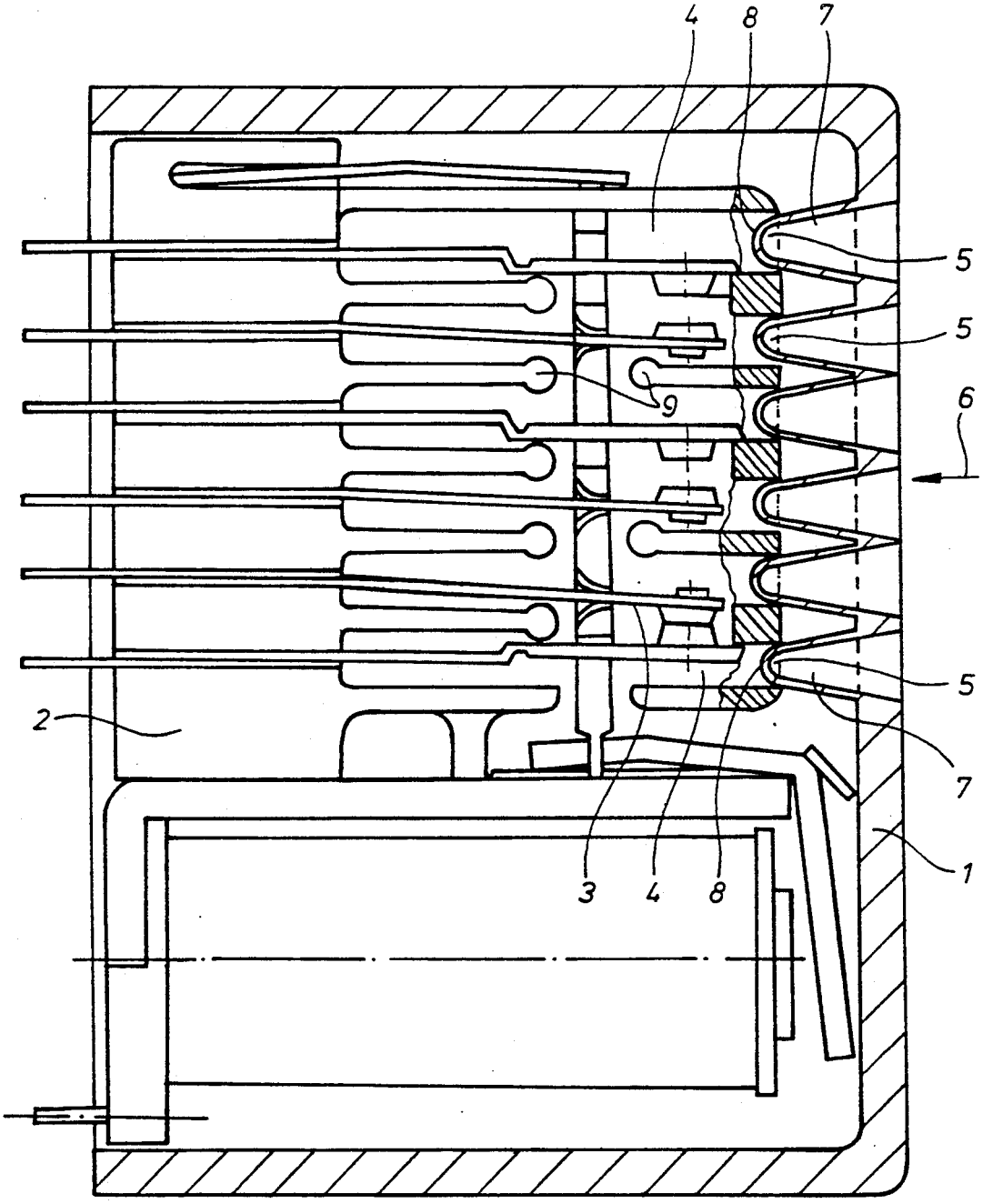
4
8
7
5
5
9
6
5
2
7
1
3
4
8

RELAY HAVING CONTACT VIEWING LENES IN THE COVER

BACKGROUND OF THE INVENTION

The invention concerns a relay with spring contact sets which are mounted on a single common spring carrier and arranged in chambers mutually separated from each other, and additionally with a removable cover for the relay.

Such a relay with a so-called safety spring set is the subject of an older patent of the applicant. It has proven itself in numerous embodiments. It is now considered advantageous to open the respective chambers on the front in order to manipulate the spring contact sets through these openings or recesses. For this operation, it is necessary that the cover surrounding the relay be removable. However, opening the chambers through the recesses described creates the danger that broken pieces of one spring contact set can penetrate through the opening in the chamber into the opening of the adjacent chamber and thus counteract this safety design.

Therefore, the objective of the invention is to further develop a relay with a spring contact set wherein the chambers of the spring contact sets mutually separated from each other are open on at least one side and have recesses such that the spring contact sets can be manipulated through the recesses without creating the danger that the broken piece of a spring contact set can penetrate via this recess in the spring carrier into an adjacent chamber.

SUMMARY OF THE INVENTION

To meet the above-noted objective, the relay with the characteristics mentioned above is characterized according to the invention in that in each chamber an opening is provided to which a projection attached to the cover is coordinated in such a way that the opening is closed when the cover is in place. Thus, the projections are arranged on the inside of the cover with their front ends at least partially meshing into the recesses of the chambers.

In accordance with a particularly advantageous embodiment, the projections arranged on the inside of the cover which mesh with the recesses in the chambers are preferably transparent. In addition, the cover is preferably transparent at least in the region of the projections.

BRIEF DESCRIPTION OF THE DRAWING

The sole FIGURE is a schematic presentation of a relay with three spring contact sets arranged in a spring carrier.

DETAILED DESCRIPTION OF THE INVENTION

A fundamental advantage obtained with the present invention is that when the cover is removed, the chambers mutually sealed off from each other are accessible via the recesses in the chamber. The spring contact sets arranged inside the chambers can be manipulated with a tool through these recesses. As soon as the cover is placed on the spring carrier of this design, the projections arranged on the inside of the cover mesh with the corresponding recesses of the chambers in such a way that these recesses are sealed as tightly as possible by these projections. The seal should at least make it impossible for small pieces which may break off of a spring contact set to escape from the chamber through these recesses and onto the projections of the cover which mesh with the recesses and possibly end up in opposing or adjacent chambers.

A particularly advantageous embodiment consists in that the cover is transparent at least in the region of the projections so that it is possible to view the spring contact sets inside the chambers from the outside (i.e., from the front) and to observe the switching status of the individual spring contact sets. For this, it is necessary that not only the cover be transparent but also the projections arranged on the inside of the cover which mesh with the recesses in the chambers.

In a further development of the present invention, it is preferred to install lenses on the ends of these projections, preferably designed as converging lenses. The projections thus have an essentially conical or triangular shape and have converging lenses on their free front ends, which lenses mesh into the recesses in the chambers. This results in a magnification effect and when viewed through these projections, the spring contact sets are magnified.

One embodiment of the present invention is described in greater detail with the help of the drawing. Additional advantages and characteristics emerge from the drawing and the description thereof.

The illustration schematically presents a relay with three spring contact sets 3 which spring contact sets 3 are arranged in a spring carrier 2. The spring carrier 2 and the magnetic drive system are sealed by a cover 1.

The actual contacts of the spring contact sets 3 are arranged in mutually sealed off chambers 4 separate from each other. The chamber walls are formed on one side by the upper surfaces of the spring carrier, by the side surfaces of the spring carrier, by the isolating ribs 9, and by the side surfaces of the cover 1.

To enable manipulation of the spring contact sets 3 in the chambers 4 from the outside with a tool when the cover 1 is removed, openings or recesses 5 are arranged in the spring carrier 2. Through these recesses 5, these spring contact sets 3 can be manipulated from the outside with a tool.

To assure that no broken pieces of the spring contact set can escape from the respective chamber 4, provision is made according to the invention that projections 7 are formed on the inside of the cover 1 opposite the recesses 5 in the chambers 4, the free front ends of which projections mesh into the recesses 5 as form-fittingly as possible. Thus, the recesses 5 are closed with the best possible seal by projections 7 of the cover 1 which mesh there.

Preferably, the cover 1 or at least the projections 7 are made of a transparent material. This assures that it is possible to monitor the contact state of the spring contact sets 3 from the outside in the direction of arrow 6 and is also possible to detect faults, such as broken pieces and the like.

It is especially advantageous here if the free front ends of the recesses 5 are designed as lenses 8 yielding a magnification effect. These lenses can—as required—be designed either as converging lenses or dispersing lenses (wide-angle lenses).

From the foregoing description, one skilled in the art can readily ascertain the essential characteristics of the invention and, without departing from the spirit and scope thereof, can adapt the invention to various usages and conditions. Changes in form and substitution of equivalents are contemplated as circumstances may suggest or render expedient, and although specific terms have been employed herein, they are intended in a descriptive sense and not for purposes of limitation.

DRAWING LEGEND

1. Cover
2. Spring carrier
3. Spring contact set
4. Chamber
5. Recess
6. Direction of arrow
7. Projection
8. Lens
9. Isolating ribs

What is claimed is:

1. A relay with a removable cover and spring contact sets mounted on a single common spring carrier and arranged in chambers mutually separated from each other, wherein each chamber is provided with an opening coordinated with a projection attached to the cover such that when the cover is in place the opening is closed, and wherein the projections terminate in lenses.

2. A relay in accordance with claim 1, wherein the cover is transparent at least in the region of the projections.

3. A relay in accordance with claim 1, wherein the openings and the projections are provided on the relay at a front portion thereof opposite the spring carrier.

* * * * *